United States Patent [19]

Shibuya et al.

[11] Patent Number: 4,518,029

[45] Date of Patent: May 21, 1985

[54] METHOD OF AND APPARATUS FOR PRODUCING THIN METALLIC SHEET BY RAPID COOLING

[75] Inventors: Kiyoshi Shibuya; Takahiro Kan; Yo Ito, all of Chiba, Japan

[73] Assignee: Kawasaki Steel Corporation, Hyogo, Japan

[21] Appl. No.: 444,518

[22] Filed: Nov. 26, 1982

[30] Foreign Application Priority Data

Dec. 4, 1981 [JP] Japan ..... 56-195789

[51] Int. Cl.[3] ..... B22D 11/00; B22D 11/06; B22D 11/124

[52] U.S. Cl. ..... 164/463; 164/423; 164/428; 164/480

[58] Field of Search ..... 164/463, 479–482, 164/423, 427–429

[56] References Cited

U.S. PATENT DOCUMENTS

| | | | |
|---|---|---|---|
| 2,171,132 | 8/1929 | Simons | 164/428 X |
| 2,450,428 | 10/1948 | Hazelett | 164/428 |
| 3,730,254 | 5/1973 | Namy | 164/428 X |
| 4,212,344 | 7/1980 | Uedaira et al. | 164/428 X |
| 4,222,431 | 9/1980 | Bryson | 164/440 X |
| 4,265,682 | 5/1981 | Tsuya et al. | 164/423 X |
| 4,274,471 | 6/1981 | Minoura et al. | 164/463 X |
| 4,301,855 | 11/1981 | Suzuki et al. | 164/423 X |

FOREIGN PATENT DOCUMENTS

| | | | |
|---|---|---|---|
| 55-33816 | 3/1980 | Japan | 164/423 |
| 56-4348 | 1/1981 | Japan | 164/463 |

*Primary Examiner*—Nicholas P. Godici
*Assistant Examiner*—J. Reed Batten, Jr.
*Attorney, Agent, or Firm*—Parkhurst & Oliff

[57] ABSTRACT

A double roll type method and apparatus for producing a thin metallic sheet by pouring a molten metal of a desired composition into a kissing region between two cooling rolls rotating in opposite directions, and rapidly cooling and solidifying the molten metal while it passes through the kissing region. The thin sheet which has come out of the kissing region is forcibly deflected by gas from a gas applying head and by a pair of pinch rolls so as to make close contact with one of the two cooling rolls over a predetermined region in the circumferential direction of the roll.

8 Claims, 2 Drawing Figures

METHOD OF AND APPARATUS FOR PRODUCING THIN METALLIC SHEET BY RAPID COOLING

BACKGROUND OF THE INVENTION

1. Field of the Invention

The present invention relates to a method of and apparatus for producing thin metallic sheets by rapid cooling and, more particularly, to an improvement in a so-called double roll type direct method and apparatus for producing thin metallic sheets, in which a molten metal of a predetermined composition is poured into the kissing region between a pair of cooling rolls rotating in opposite directions and is rapidly cooled and solidified to become thin metallic sheet as it passes through the kissing region. The term "kissing region" is defined by a region where a pair of rolls come close to or contact each other.

2. Description of the Prior Art

Hitherto, some methods have been proposed for producing an amorphous thin metallic sheet or a fine crystalline thin metallic sheet, such as a single roll type method in which the molten metal is poured onto a cooling roll and is rapidly cooled on the latter, and a belt type method in which the molten metal is poured onto a cooling moving belt so as to be cooled on the latter, in addition to the aforementioned double roll type method which makes use of a pair of cooling rolls.

In the conventional double roll type method for producing thin metallic sheet, the molten metal is poured into the kissing region between the two rolls from the upper side and the thin metallic sheet coming out of the kissing region is guided to naturally fall downward, without effecting any forcible change of outgoing direction. The conventional double roll type method, therefore, involved the following merits and demerits as compared with the single roll type method.

(i) Cooling Effect

In the double roll type method, the time of contact between the metal and the cooling rolls is very short. Therefore, it may not be possible to obtain amorphous structure due to insufficient cooling after the solidification. In the production of metallic sheet having fine crystalline structure, the sheet suffers a heavy oxidation due to too short a contact period, causing it to exhibit black color at its surface due to the oxidation and to become unacceptable as commercial goods.

In contrast, the single roll type method is free from these problems because, in this method, it is possible to keep the molten metal in contact with the roll for sufficiently long period of time.

(ii) State of Contact

In the double roll type method, the sheet is cooled on both its sides while pressurized and clamped between the two cooling rolls. It therefore is possible to maintain a good state of contact between the rolls and the molten metal and, hence, to produce metallic sheets having comparatively large thicknesses of about 60 to 150 μm.

On the other hand, in the single roll method, the thin sheet is contacted by the single roll only on one side while the other side is kept free and subjected to natural cooling or gas cooling. Thus, the state of contact between the sheet and the roll is not as good as that in the double roll type method and, hence, the product sheet is usually as thin as 30 to 50 μm at the thickest.

(iii) Nature of Sheet Surface

In the double roll type method, it is possible to maintain a good state of contact between the sheet and rolls because the sheet is pressed from both sides thereof by the rolls. It therefore, is, possible to produce uniform sheet surfaces. However, in the single roll type method, gas is often trapped in the roll contacting surface of the sheet and the free surface of the sheet tends to have convexities and concavities, because the sheet is merely deposited to the roll surface. Therefore, with the single roll type method, it may not be possible to attain a good quality sheet surface as compared with the double roll type method.

SUMMARY OF THE INVENTION

Accordingly, it is an object of the invention to provide a method of and apparatus for producing thin metallic sheet by rapid cooling, improved to avoid the aforementioned drawbacks of the conventional double roll type method while taking most of the advantages of the same, as well as the advantages of the single roll type method.

More specifically, the invention aims as its primary object to provide a method of and apparatus for producing thin metallic sheets by rapid cooling, which is capable of providing superior cooling effects and good conditions of contact between the sheet and roll, thereby ensuring good surface quality of the metallic sheet product.

According to the invention, the above-described object is achieved by effecting the rapid cooling of a thin metallic sheet coming out of the kissing region between two cooling rolls, while keeping the sheet in close contact with one of two cooling rolls over a predetermined region in the circumferential direction of the roll, e.g. 90°, after the sheet has come out of the kissing region.

According to one aspect of the invention a double roll type method of producing a thin metallic sheet by rapid cooling is employed, wherein a molten metal is poured into the kissing region between a pair of cooling rolls rotating in opposite directions. The cooling rolls rapidly cool and solidify the molten metal while the molten metal passes through the kissing region, thereby to producing the thin metallic sheet. The rapid cooling of the thin metallic sheet coming out of the kissing region is furthered by keeping the sheet in close contact with the surface of either one of the two cooling rolls over a predetermined region in the circumferential direction of the roll.

Preferably, a cooling gas is applied to the thin metallic sheet at a position downstream from the kissing region as viewed in the direction of movement of the thin metallic sheet. Additionally the thin metallic sheet preferably is tensed by pinch rolls disposed at the downstream side of the position of application of the cooling gas in such a manner as to forcibly change the direction of movement of the thin metallic sheet to keep the same in close contact with one of two rolls.

According to another aspect of the invention, there is provided an apparatus which is suitable for carrying out the method summarized above.

DESCRIPTION OF THE PREFERRED EMBODIMENTS

A preferred embodiment of the invention will be described hereinunder with reference to the accompanying drawings.

Figure 1:
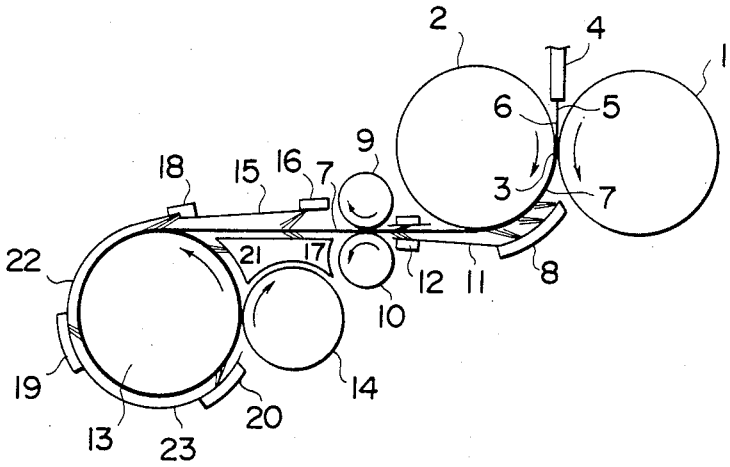
FIG. 1 is an explanatory diagram showing an embodiment of the present invention.

Referring first to FIG. 1, there are provided a pair of cooling rolls adapted to rotate in opposite directions, namely, a right cooling roll 1 adapted to rotate in the counter-clockwise direction and a left cooling roll 2 adapted to rotate in the clockwise direction as viewed in FIG. 1. A kissing region 3 is formed between these two cooling rolls 1 and 2. A molten metal 5 is poured into the kissing region 3 from a pouring nozzle 4 disposed above the kissing region so that a puddle 6 of molten metal is formed in the upper part of the kissing region 3.

As the cooling rolls 1 and 2 rotate in their respective directions, the molten metal 5 is passes through the kissing region while being pressurized from both sides thereof by the cooling rolls 1 and 2 and is rapidly cooled and solidified by these cooling rolls. The solidified metal in the form of a thin sheet 7 is pulled out of the kissing region 3 downwardly.

A gas applying header 8 is disposed in the vicinity of the kissing region 3 at the downstream side of the latter as viewed in the direction of movement of the thin sheet 7. A cooling gas such as air or nitrogen gas is jetted from the header 8 and impinges upon one side (the right side in the illustrated embodiment) of the thin sheet 7 so as to deflect the thin sheet 7 towards one of the rolls (the left roll 2 in the illustrated embodiment) while promoting the cooling of the thin sheet.

A pair of pinch rolls 9 and 10, disposed at the downstream side of the header 8, are adapted to rotate in synchronism with the peripheral speed of the cooling rolls 1 and 2 and to pinch and pull the solidified thin sheet 7, thereby to impart a predetermined tension to the thin sheet 7 while keeping the thin sheet in contact with the cooling roll 2 over a predetermined region in the circumferential direction of the roll 2. In the illustrated embodiment, the thin sheet 7 is kept in contact with the roll 2 over a region of about 90° from the kissing region 3 in the circumferential direction of the roll 2, and is sufficiently rapid-cooled while it is held in contact with the cooling roll 2.

In the illustrated embodiment, a guide 11 is disposed adjacent to and downstream from the gas applying header 8 so as to horizontally deflect the thin sheet 7 which comes out of the kissing region 3 vertically downwardly. In addition, another gas applying header 12 is disposed in the vicinity of and upstream from the pinch rolls 9 and 10. The cooling gas jetted from this header 12 promotes the cooling of the thin sheet 7 and facilitates the running of the thin sheet 7 into the pinch rolls 9 and 10. The header 12, in addition to cooling the thin sheet 7 adjusts the course of the thin sheet 7 by applying the gas to both sides of the thin sheet 7.

A take-up reel 13 is disposed at the downstream side of the pinch rolls 9 and 10. This take-up reel is adapted to be driven in the illustrated direction by a reel drive roll 14 through frictional engagement with the latter, thereby to take-up the thin sheet 7, which is forwarded continuously. A guide 15 for guiding the thin sheet 7 and a suitable number of gas applying headers 16 and 17 are disposed intermediate between the pinch rolls 9,10 and the take-up reel 13.

Furthermore, a suitable number of gas applying headers 18,19,20,21 and guides 22,23 are disposed around the take-up reel 13 so as to further cool the thin sheet 7 and to ensure smooth taking up of the thin sheet 7 by the take-up reel 13.

In the described embodiment of the invention, the thin sheet 7 coming out of the kissing region between the cooling rolls 1 and 2 is cooled and deflected by the gas jetted from the gas applying header 8 disposed immediately under the rolls 1 and 2, and is held securely in close contact with the roll 2 of the two cooling rolls 1 and 2. Therefore, the thin sheet 7 is effectively cooled rapidly at its respective sides by the cooling roll 2 and the cooling gas and, hence, the product thin sheet can have a good amorphous structure. For the same reason, the undesirable oxidation of the thin sheet 7 is prevented effectively. In addition, the solidified thin sheet 7 can effectively be separated from the cooling rolls 1 and 2. The provision of the pinch rolls 9 and 10 offers various advantages in addition to the smooth transfer of the thin sheet 7, such as tightness of contact between the thin sheet 7 and the cooling roll during the rapid cooling, additional separating force for separating the thin sheet from the cooling roll and moderate tension which ensures a smooth and tight coiling of the thin sheet during the taking up of the same.

The thin sheet 7 delivered by the pinch rolls 9 and 10 is wound round the take-up reel 13 by the action of the cooling gas and by the presence of the guide, and is taken up and coiled uniformly at a moderate tension which is given by the pinch rolls 9,10 and the take-up reel 13 as the latter is driven by the reel drive roll 14.

As will be understood from the foregoing description, according to the method of the described embodiment, it is possible to keep the thin sheet 7 in close contact with the cooling roll for a time long enough to ensure sufficient rapid cooling. It therefore is possible to produce a thin metallic sheet of the desired good quality having uniform structure, regardless of whether it is amorphous or fine crystalline structure, and devoid of any blackening due to oxidation.

Test production of thin metallic sheets was conducted by the single roll type method, the conventional double roll type method and the double roll type method of the present invention under the following conditions, the following results:

Condition:
- Composition of thin film: 6.5% Si-Fe
- Cooling Roll Dia.: 400 mm
- Cooling Roll Peripheral Speed: 15 m/sec
- Cooling Roll Material: 3% Be-Cu
- Kind of Cooling Gas: $N_2$ Result:
- Thickness of sheets produced
  - Single roll type: 30 μm
  - Conventional roll type: 100 μm
  - Double roll type of invention: 100 μm
- Color of the surface of sheets produced
  - Single roll type: silver white
  - Conventional double roll type: black by oxidation
  - Double roll type of invention: silver white
- Roughness of the surface of sheets produced (average roughness along center line)
  - Single roll type:
    - 2 μm(roll surface)
    - 3 μm(free surface)
  - Conventional double roll type: 1 μm Double roll type of invention: 1 μm As will be clearly seen from the foregoing description, according to the described embodiment of the invention, there is provided a double roll type method and apparatus for producing thin metallic sheet, in which the thin sheet coming out of the kissing region between the two cooling rolls is held in contact with the surface of either one of the cooling rolls for a predetermined period of time so as to ensure a high cooling effect while enjoying the advantages of the single roll type method and apparatus.

Figure 2:
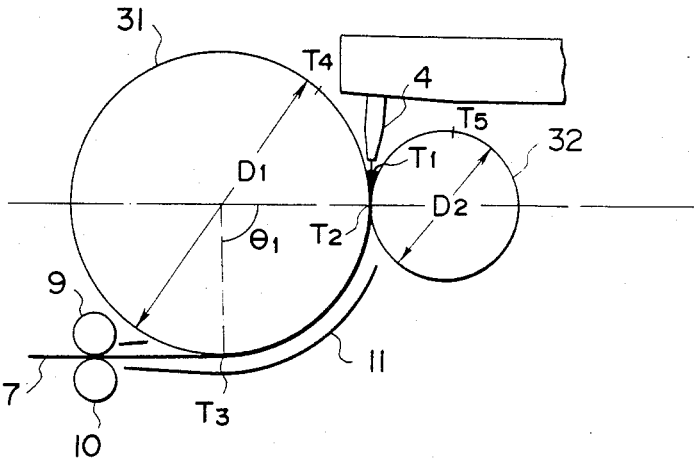
FIG. 2 is an exploded explanatory diagram showing a practical embodiment of the present invention.

Referring now to FIG. 2 showing another embodiment of the invention, two cooling rolls 31 and 32 have different diameters. More specifically, the cooling roll 31 adapted to be closely contacted by the thin sheet over a predetermined region has a diameter greater than that of the other cooling roll 32.

Representing the diameters of the larger roll 31 and smaller roll 32 by $D_1$ and $D_2$, respectively, the temperature of the molten metal coming out of the pouring nozzle 4 by $T_1$, the temperature of the thin sheet at the outlet side of the kissing region by $T_2$ and the temperature at which thin sheet 7 is separated from the large roll 31 by $T_3$, the relationships given by the following formulae are established between the amounts of heat (heat output) derived from the thin sheet and the roll diameter ratio.

The thermal load imposed on the large roll per unit time is given by the following formula (1).

$$Q_1 = W\left\{\frac{\Delta H + (T_1 - T_2)C_p}{2} + (T_2 - T_3)C_p\right\} \text{ (cal/sec)} \quad (1)$$

Similarly, the thermal load imposed on the small roll per unit time is given by the following formula (2).

$$Q_2 = W\left\{\frac{\Delta H + (T_1 - T_2)C_p}{2}\right\} \text{ (cal/sec)} \quad (2)$$

In these formulae (1) and (2), the symbol ΔH represents the solidification latent heat (cal/g) of the thin sheet, Cp represents the specific heat (cal/g°C.) of the same, and W represents the weight of the thin sheet produced per second (g/sec).

The rates of heat transfer to the cooling medium circulated in the large roll and in the small roll are given by the following formulae (3) and (4), respectively.

$$q_1 = h_1 \cdot \pi D_1 \cdot A \cdot \Delta T_1 \text{(cal/sec)} \quad (3)$$

$$q_2 = h_2 \cdot \pi D_2 \cdot A \cdot \Delta T_2 \text{(cal/sec)} \quad (4)$$

where, h represents the heat transfer coefficient (cal/cm$^2$ sec°C.) between the roll sleeve and the cooling medium, A represents the product (cm) of the sleeve width and the groove shape coefficient and ΔT represents the temperature difference (°C.) between the cooling water and the roll sleeve.

The flow rates of the cooling medium are so determined that the condition of the following formula (5)

$$h_1 \Delta T_1 = h_2 \Delta T_2 \quad (5)$$

is met, namely to satisfy the condition of $q_1/q_2 = D_1/D_2$.

The heat capacities of the large and small rolls are given by the formulae (6) and (7), respectively.

$$V_1 = C_s \cdot \rho \cdot \pi D_1 \cdot t \cdot b \quad (6)$$

$$V_2 = C_s \cdot \rho \cdot \pi D_2 \cdot t \cdot b \quad (7)$$

where,

Cs: specific heat of roll sleeve (cal/g°C.)

ρ: density of roll sleeve (g/cm$^3$)

t: thickness of roll sleeve (cm)

b: breadth of roll sleeve (cm)

In order for both the large and small rolls to exhibit an equal temperature rise, the condition expressed by the following formula (8) must be met.

$$\frac{Q_1 - q_1}{V_i} = \frac{Q_2 - q_2}{V_2} \text{ (°C./sec)} \quad (8)$$

A steady state of the roll sleeve temperature is obtained when both of the conditions $Q_1 - q_1 = 0$ and $Q_2 - q_2 = 0$ are satisfied.

The relationship expressed by the following formula (9) is obtained by substituting formulae (1) to (7) into formula (8).

$$D_1/D_2 = \left\{\frac{\Delta H + (T_1 - T_2)C_p}{2} + (T_2 - T_3)C_p\right\} / \left\{\frac{\Delta H + (T_1 - T_2)C_p}{2}\right\} \quad (9)$$

According to typical physical data of iron system metals, the solidification latent heat ΔH is about 65 Cal/g, while the specific heat Cp is generally 0.15 Cal/g°C. The temperature differences $T_1$-$T_2$ and $T_2$-$T_3$ can be assumed generally to range between 200° and 300° C. and between 400° and 500° C., respectively.

By substituting these physical data for the right side of the formula (9), the following formula (10) is derived.

$$1.5 \leqq D_1/D_2 \leqq 2.5 \quad (10)$$

This calculation is a rough one and a minute heat balance calculation by a computer is necessary for precise results. It is to be noted that a substantially equivalent conclusion was obtained through such a minute calculation to that derived from the formula (10) above.

An example of the results of tests conducted by the present inventors is shown below. The test was conducted by using two rolls: a large roll having a diameter $D_1$ of 800 mm and a small roll having a diameter $D_2$ of 400 mm. Thus, the diameter ratio $D_1/D_2$ was 2. The angle θ of deflection of the outcoming thin sheet, i.e., the angle formed between the direction in which the thin sheet emerges from the kissing region and the direction in which the thin sheet runs after leaving the cooling roll, was selected to be 90°. Internally water-cooled rolls were used at a peripheral speed of 10 m/sec and a pressure of 3 Tons. Copper alloy was used as the material of the roll sleeves. Under these conditions: 50 Kg of 5.5% Si-Fe was poured at a pouring temperature of 1550° C. to be cooled rapidly. In consequence, a thin sheet of 150 μm thick and 100 mm wide was formed at a steady temperature $T_3$ of 650±50° C. at the large roll outlet side which exhibited a silver gray color on the surfaces thereof. The surface temperatures $T_4$ and $T_5$ of the large and small rolls immediately upstream from the puddle of molten metal were 200±300° C., respectively, in the steady state. The temperature difference between two rolls was as small as 60° C. at the greatest.

What is claimed is:

1. A double roll type method of producing a thin sheet by rapid cooling, comprising the steps of:

pouring molten metal into a kissing region between a pair of cooling rolls rotating in opposite directions;

rapidly cooling and solidifying the molten metal into a thin sheet while said molten metal passes through said kissing region;

applying a cooling gas to the thin sheet coming out of said kissing region to further cool the thin sheet and to deflect the thin sheet towards a surface of one of said cooling rolls so as to bring the thin sheet in contact with said surface of said one of said cooling rolls; and imparting a tension to the thin sheet by a pair of pinch rolls disposed at a downstream side of a position of application of said cooling gas, whereby the thin sheet is kept in close contact with said surface of said one of said cooling rolls over a predetermined region in a circumferential direction of said surface.

2. A method of producing a thin sheet as claimed in claim 1, wherein said thin sheet coming out of said kissing region is held in close contact with the surface of said one of said cooling rolls over a circumferential angular region of about 90°.

3. A double roll type apparatus for producing a thin sheet by rapid cooling, comprising:

a pair of cooling rolls rotating in opposite directions forming a kissing region between said cooling rolls wherein a molten metal is poured into said kissing region and the molten metal is rapidly cooled and solidified to become a thin sheet as it passes through said kissing region;

a gas applying header disposed downstream from and in the vicinity of said kissing region to apply a cooling gas to a surface of said thin sheet so as to deflect said thin sheet towards one of said cooling rolls; and a pair of pinch rolls disposed downstream from said gas applying header, said pinch rolls rotating in synchronism with said cooling rolls thereby to impart a tension to said thin sheet, whereby said gas applying header and said pinch rolls cooperate with each other in deflecting said thin sheet into close contact with the surface of said one of said cooling rolls over a predetermined region in the circumferential direction of said cooling roll, thereby to further cool said thin sheet rapidly.

4. An apparatus for producing a thin sheet as claimed in claim 3, wherein the cooling rool contacted by said thin sheet over said predetermined region has a diameter greater than that of the other cooling roll.

5. An apparatus for producing a thin sheet according to claim 4, wherein the diameter $D_1$ of the larger cooling roll and the diameter $D_2$ of the smaller cooling roll are determined to meet the following condition:

$$1.5 \leqq D_1/D_2 \leqq 2.5.$$

6. An apparatus for producing a thin sheet according to claim 3, further comprising a guide disposed between said gas applying header and said pinch rolls to guide said thin sheet towards said pinch rolls.

7. An apparatus for producing a thin sheet as claimed in claim 6, further comprising a gas applying header disposed in the vicinity of the inlet side of said pinch rolls for applying a cooling gas for cooling said thin sheet and guiding said thin sheet to a kissing region between said pinch rolls.

8. An apparatus for producing a thin sheet as claimed in claim 3, further comprising:

a take-up reel disposed at the outlet side of said pinch rolls;

a suitable number of gas applying headers arranged around said take-up reel to apply a cooling gas to said thin sheet; and guides arranged around said take-up reel.

* * * * *